US007160228B2

(12) United States Patent
Liu

(10) Patent No.: US 7,160,228 B2
(45) Date of Patent: Jan. 9, 2007

(54) STRUCTURE FINGER STRENGTHENING DEVICE

(76) Inventor: Yao-Yu Liu, No. 74, Lane 6, Sec. 1, Chung Shan Road, Mei-Gang Village, Dacun Township, Changhua Hsien (TW)

( * ) Notice: Subject to any disclaimer, the term of this patent is extended or adjusted under 35 U.S.C. 154(b) by 0 days.

(21) Appl. No.: 11/050,771

(22) Filed: Feb. 7, 2005

(65) Prior Publication Data

US 2006/0178247 A1 Aug. 10, 2006

(51) Int. Cl.
*A63B 21/00* (2006.01)

(52) U.S. Cl. ..... 482/48; 482/49

(58) Field of Classification Search ..... 482/49, 482/48, 47, 121; 128/845, 878; 601/40
See application file for complete search history.

(56) References Cited

U.S. PATENT DOCUMENTS 1,790,934 A * 2/1931 Lobosicky ..... 482/48
3,606,316 A * 9/1971 Krewer ..... 482/47
5,050,875 A * 9/1991 Lewkovich ..... 482/128

* cited by examiner

*Primary Examiner*—Jerome Donnelly
(74) *Attorney, Agent, or Firm*—Rabin & Berdo, P.C.

(57) ABSTRACT

An improved structure finger strengthening device, the design of which features elastic components installed between upper and lower housings and finger sleeves. The fingers of the user are inserted into the finger sleeves, the fingers then forced outward and relaxed inward for conditioning and drilling. At the same time, the present invention provides for simple assembly and component replacement.

10 Claims, 5 Drawing Sheets

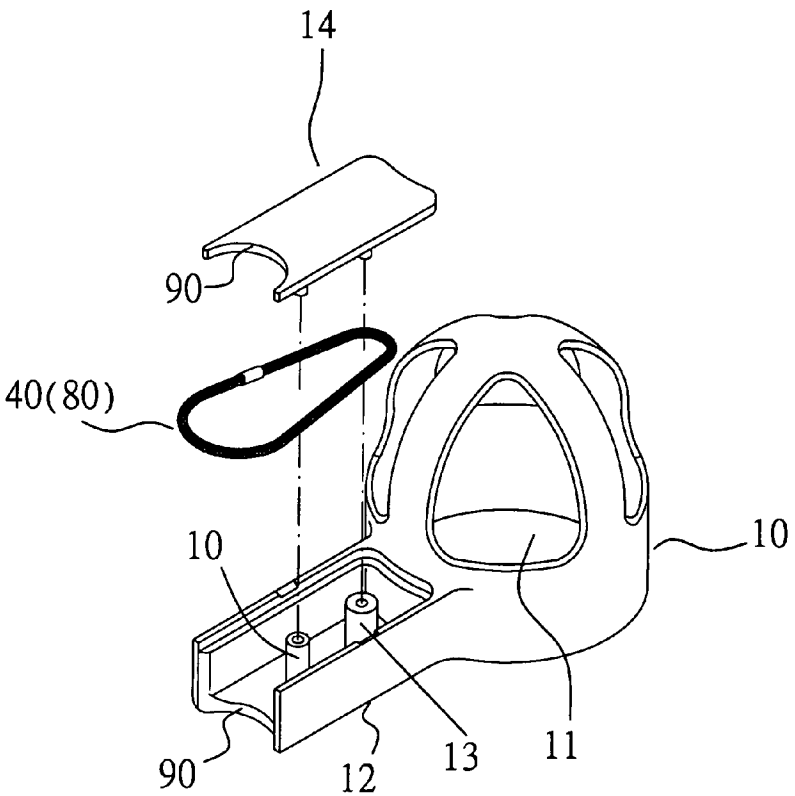
FIG. 2-B
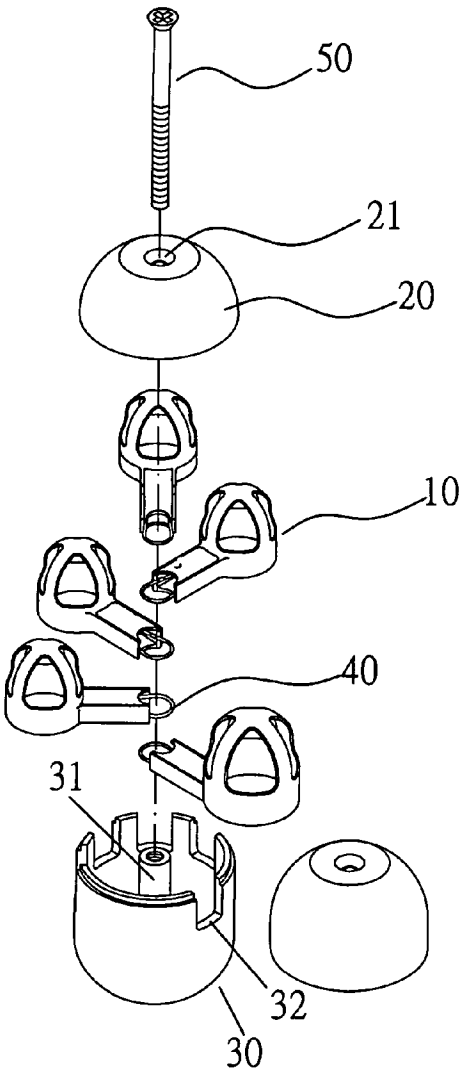
FIG. 2-A

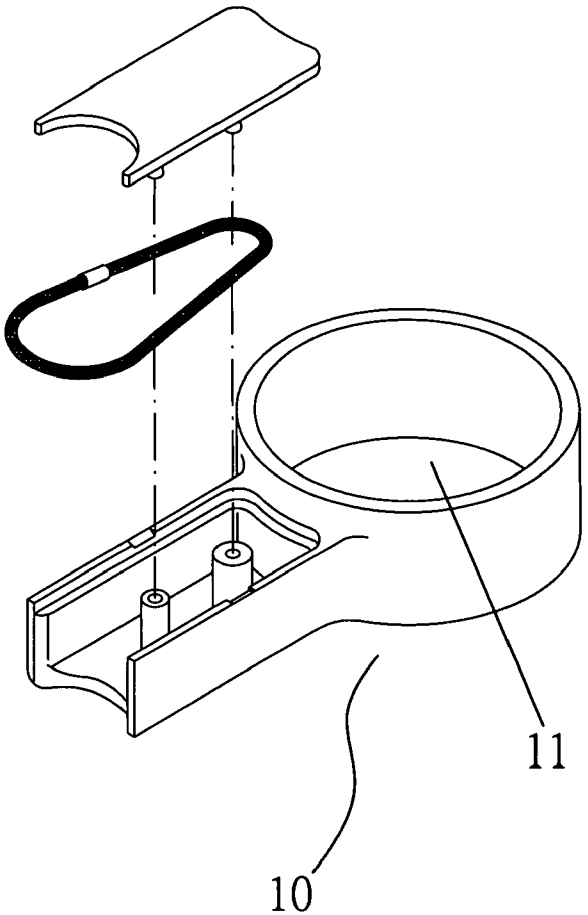
FIG. 3-B
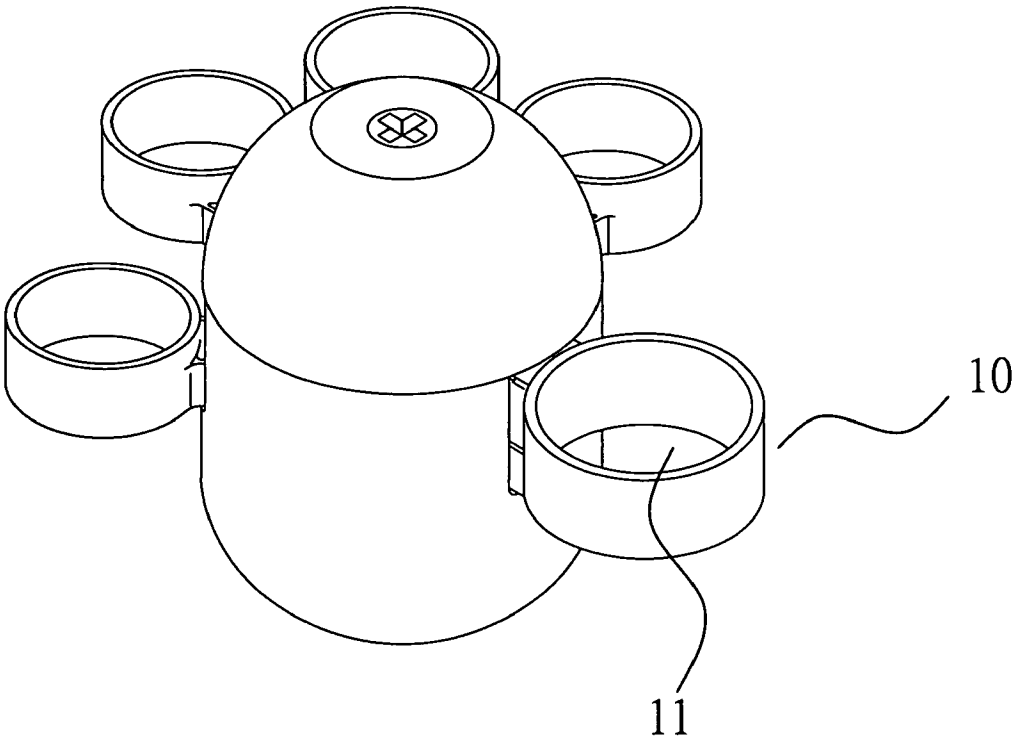
FIG. 3-A

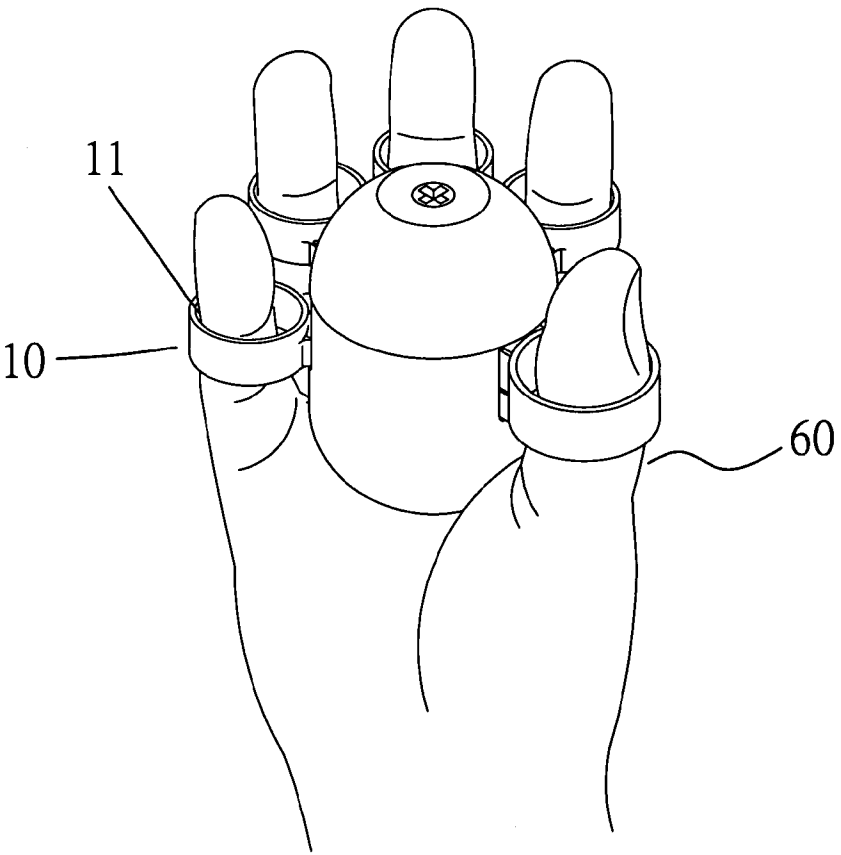
FIG. 4-B
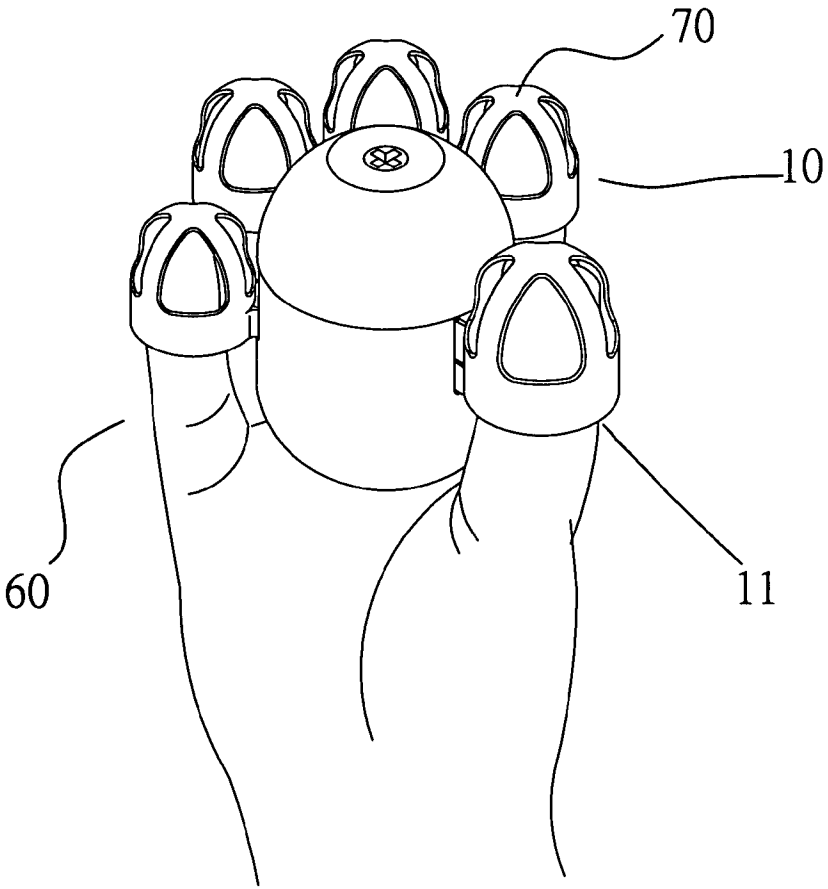
FIG. 4-A

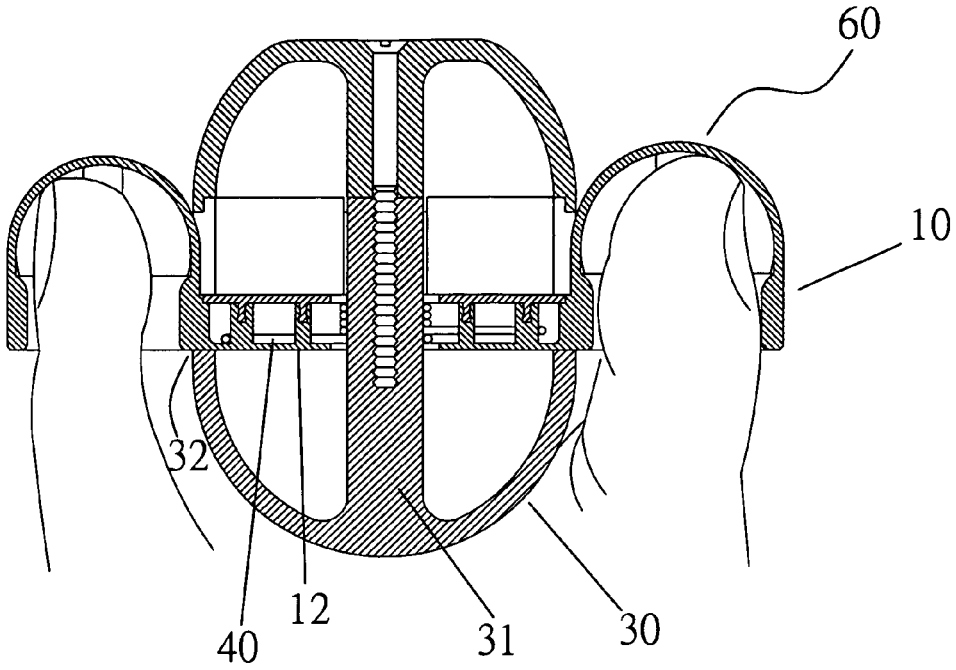
FIG. 5-A
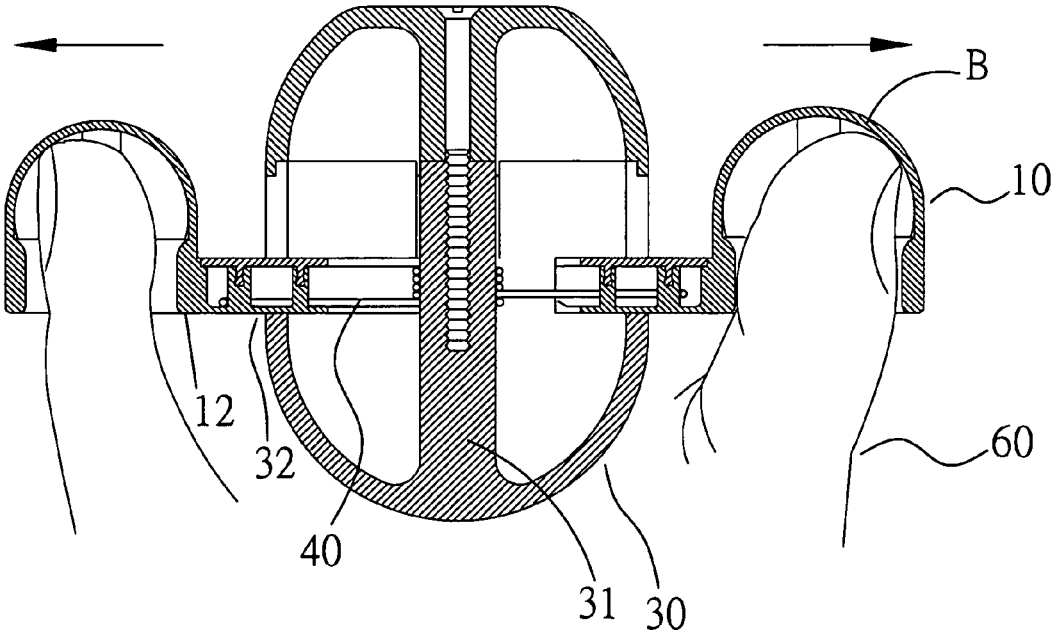
FIG. 5-B

STRUCTURE FINGER STRENGTHENING DEVICE

BACKGROUND OF THE INVENTION

1) Field of the Invention

The invention herein relates to an improved structure finger strengthening device, the design of which features elastic components installed between the upper and lower housings and the finger sleeves, wherein the fingers of the user are inserted into the finger sleeves, the fingers then forced outward and relaxed inward for conditioning and drilling; at the same time, assembly and component replacement is simple.

2) Description of the Prior Art

Conventional hand grips currently available on the market for user squeeze and release exercises typically consists of two handles with springs in between for rebound force and thereby providing for physical hand drilling and conditioning. Moreover, these products have become somewhat indispensable for daily life.

Therefore, if such hand grips in addition to general drill and conditioning applications can integrate a design arrangement that meets ergonomic considerations and achieves user product appeal as well as enhanced portability along with easily replaceable components and the elimination of accidental injury and finger bone breakage due to sharp edges, manufacturers promoting these products will enjoy rapid assembly, convenience, and profitability.

The invention herein relates to an improved structure finger strengthening device, the design of which features elastic components installed between the upper and lower housings and the finger sleeves, wherein the fingers of the user are inserted into the finger sleeves, the fingers are then forced outward and relaxed inward for conditioning and drilling; at the same time, assembly and component replacement is simple.

2) DESCRIPTION OF THE PRIOR ART

Conventional hand grips currently available on the market for user squeeze and release exercises typically consist of two handles with springs in between for rebound force and thereby providing for physical hand drilling and conditioning. Moreover, these products have become somewhat indispensable for daily life.

Therefore, if such hand grips in addition to general drill and conditioning applications can integrate a design arrangement that meets ergonomic considerations and achieves user product appeal as well as enhanced portability along with easily replaceable components and the elimination of accidental injury and finger bone breakage due to sharp edges, manufacturers promoting these products will enjoy rapid assembly, convenience, and profitability.

However, most hand grips on the market are in an V-shaped arrangement consisting of two outwardly angled handles and a spring in between, with the said spring exposed. Although the handle ends have protective covers to shield sharp areas, physical injury readily from handle impact occurs when the user accidentally falls and, at the same time, the exposed spring pinches the user. Additionally, the finger strengthening and conditioning efficiency of such products is not evident and they cannot be operated comfortably by users. Therefore, such hand grips require redesign and improvement.

As a result, the applicant of the invention herein concluded that conventional hand grips have two aspects that require improvement:

1. The handle shape and spring placement area are not conducive to comfortable user operation, which easily results in injury and pinching during user operation and carrying.
2. The finger strengthening and conditioning efficiency of such products is questionable and even requires the use of the palm to squeeze the handles.

In view of the foregoing situation, the applicant of the invention herein addressed the drawbacks of the prior art hand grips and developed the improved structure finger strengthening device of the present invention.

SUMMARY OF THE INVENTION

The objective of the invention herein is to provide an improved structure finger strengthening device, the design of which features elastic components installed between the upper and lower housings and the finger sleeves, ergonomically shaped components, and an exterior capable of accommodating various patterns in an arrangement that overcomes the pinch injury propensity, uncomfortable operation, component replacement, and difficult assembly drawbacks of the prior art product.

BRIEF DESCRIPTION OF THE DRAWINGS

FIG. 2-A is an exploded drawing of FIG. 1.

FIG. 2-B is an exploded drawing of the finger sleeve embodiment of the invention herein.

FIG. 3-A is an isometric drawing of the second embodiment of the invention herein.

FIG. 3-B is an exploded drawing of the finger sleeve in FIG. 3-A.

FIG. 4-A is an isometric drawing of user fingers fitted into the first finger sleeve embodiment of the invention herein.

FIG. 4-B is an isometric drawing of user fingers fitted into the second finger sleeve embodiment of the invention herein.

FIG. 5-A is a cross-sectional drawing of the first embodiment of the invention herein before operation.

FIG. 5-B is a cross-sectional drawing of the first embodiment of the invention herein after operation.

DETAILED DESCRIPTION OF THE PREFERRED EMBODIMENTS

Figure 1:
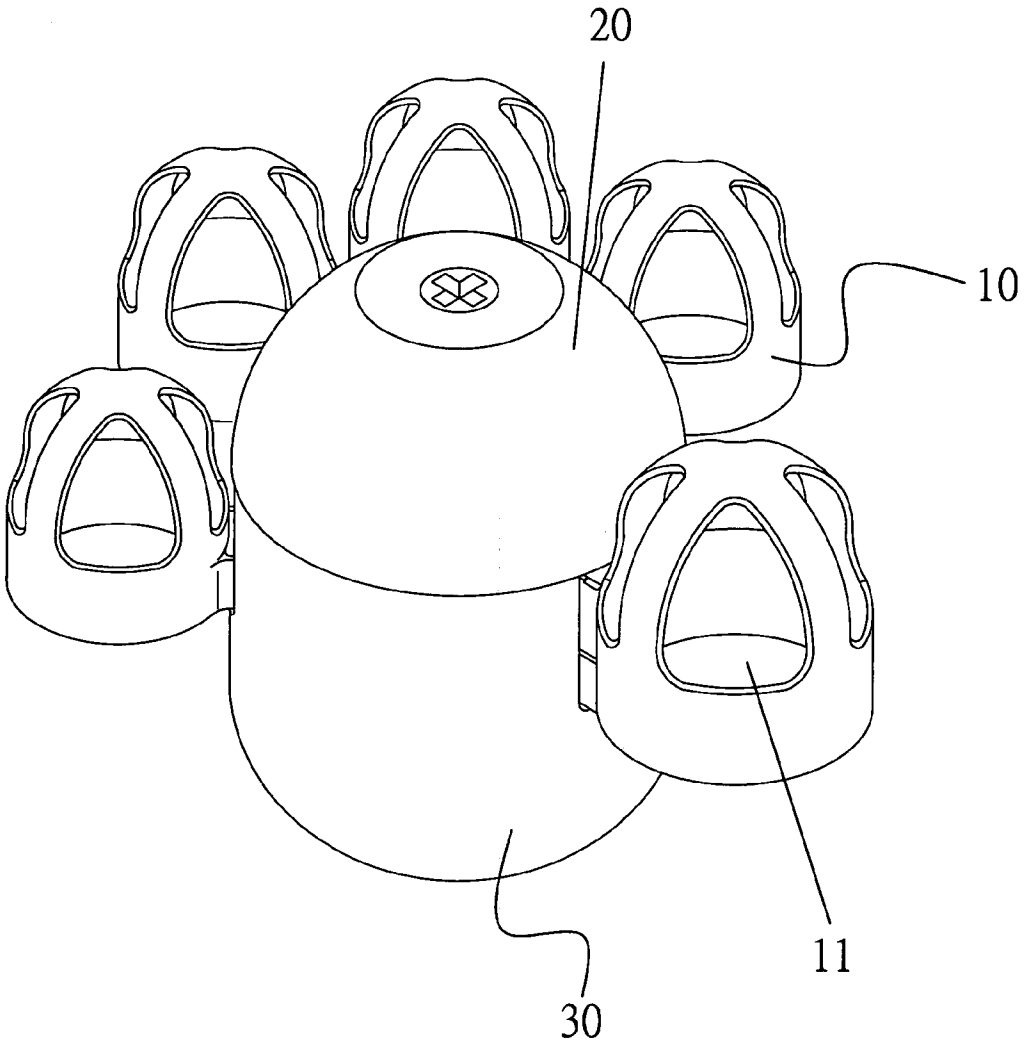
FIG. 1 is an isometric drawing of an embodiment of the invention herein.

The brief description of the drawings are followed by the detailed description of the preferred embodiments. Referring to FIG. 1, the isometric drawing of the embodiment of the invention herein, the shape of the upper and lower housing 20 and 30 as well as the finger sleeves 10 are defined by flowing lines such that they comply with ergonomics to provide for user comfort; since the fingers 60 of the user (see FIG. 4) extend into the finger sleeve 10 entrances 11 for anchoring and the fingertips are individually situated against the reticulations 70 of the said finger sleeves 10, the hand (including the area between the thumb and index finger) of the user grasps the lower housing 30 such that when the fingers 60 force the finger sleeves 10 apart, finger strength is drilled and conditioned.

Referring to FIG. 2-A and FIG. 2-B the exploded drawing of the FIG. 1 and the exploded drawing of the finger sleeve embodiment of the invention herein, respectively, the invention herein is comprised of an upper housing 20 assembled 5 to a lower housing 30, a post 31 disposed inside the lower housing 30, guide slots 32 formed along the outer rim of the housing 30 to provide for the insertion of the finger sleeves 10, and an elastic component 40 (in this embodiment, a rubber band 80) installed between the post 31 and each finger sleeve 10; given such a structure, the fingers 60 of the user inserted into the finger sleeves 10, the fingers 60 then are forced outward and relaxed inward for conditioning and drilling; at the same time, assembly and component replacement is simple (see FIG. 4).

Each finger sleeve 10 consists of an annular entrance 11 at one end and a slide track 12 at the other end; the elastic component 40 is installed onto a post 13 inside the slide track 12, and a cover 14 is placed over the interior upper edge of the slide track 12.

The upper housing 20 has a screw hole 21 in its bottom, enabling the insertion of a fastening component 50 into the lower housing 30 and post 31; the fastening component 50 can be a threaded bolt or a threaded rod, etc.

The elastic component 40 is a rubber band 80, but a spring or other component can also be utilized.

The track 12 and cover 14 are both designed with an arcuate surface 90 at one end that is seated against the post 31 of lower housing 30, enabling a perfect fit between components.

Referring to FIG. 3-A and FIG. 3-B, the isometric drawing of the second embodiment of the invention herein and the exploded drawing of the finger sleeve in FIG. 3-A, no reticulations 70 (as shown in FIG. 1) are formed in the lateral surfaces of the finger sleeve entrances 11, the purpose of utilizing a design in which the finger sleeves 10 lack reticulations 70 allows the user to insert fingers 60 into the entrances 11 at various depths such that the joints of each finger 60 can be selectively drilled and conditioned, which functionally achieves balanced design concept (see FIG. 4).

Referring to FIG. 4-A and FIG. 4-B, the isometric drawings of a user's fingers fitted into the first and the second finger sleeve embodiments of the invention herein, the finger sleeves 10 on the left having reticulations 70 allows the insertion of the entire joint at the front portion of the fingers 60 for finger strengthening drills and conditioning; conversely, the finger sleeve entrances 11 on the right without the design in the drawing to the left allows the user to insert fingers 60 as required to drill and condition any finger 60 joint.

Referring to FIG. 5-A and FIG. 5-B, the cross-sectional drawing of the first embodiment of the invention herein before and after operation, the front portions of the user fingers 60 are entirely inserted into the finger sleeves 10, the fingertips situated against the reticulations 70 and stably nested, the lower housing 30 bottom defined by curved lines that are harmless to the user, five elastic components 40 are sequentially stacked on the post 31 of lower housing 30, the finger sleeve slide track 12 is completely extended into the lower housing guide slot 32, and the elastic component 40 is in a tensile state because no force has been exerted; conversely, in the lower drawing, since the finger sleeves 10 have been pulled outward by the force of the fingers 60, the slide track 12 moves in the guide slot 32 as the elastic component 40 simultaneously produces a resistant force in the opposite direction, the operation depicted in the upper and lower drawing illustrating the mechanism of finger strengthening drill and conditioning.

In summation of the foregoing section, the improved structure finger strengthening device of the invention herein possesses the following advantages:

1. The shapes of the housings 20 and 30 and the finger sleeves 10 are defined by flowing lines such they not only comply with ergonomics and provide for user operating comfort, but the non-reticulated design of the finger sleeves 10 enables the user to insert fingers 60 into the entrances 11 at various depths such that the joints of each finger 60 can be selectively drilled and conditioned, functionally achieving a balanced design concept.
2. The color and pattern design of the housings 20 and 30 as well as the finger sleeves 10 increase marketing feasibility, departs from the conventional, and attracts customers that prefer variety.
3. Utilizing an assembly-type design enables factory production assembly and repair with no risk of pinch injury during user operation and carrying; components are user replaceable.

However, the description only discloses the most preferred embodiments of the invention herein and which shall not be construed as a limitation on the scope of the present invention, All modifications and adaptations based on the patent application claims of the invention herein shall remain protected under the patented claims of the present invention.

Therefore, the improved structure finger strengthening device of the applicant meets new patent application requirements and is submitted to the patent bureau for review and the granting of the commensurate patents rights.

The invention claimed is:

1. A finger strengthening device, comprising:

a plurality of finger sleeves, each including an annular entrance at one end and a slide track at another end;

a lower housing having a post disposed therein, and a plurality of guide slots formed along an outer rim thereof to provide for the insertion of the finger sleeves;

an upper housing assembled to the lower housing; and at least one elastic component installed between the post and each finger sleeve;

wherein fingers of a user are inserted into the finger sleeves, with the fingers being then forced by the user outward and relaxed inward for conditioning and drilling.

2. The finger strengthening device recited in claim 1, wherein the elastic component is a rubber band.

3. A finger strengthening device, comprising:

a plurality of finger sleeves;

a lower housing having a post disposed therein, and a plurality of guide slots formed along an outer rim thereof to provide for the insertion of the finger sleeves;

an upper housing assembled to the lower housing, said upper housing having a screw hole in a bottom thereof;

a fastener insertable through the screw hole and into the post to fix the lower housing to the upper housing; and at least one elastic component installed between the post and each finger sleeve;

wherein fingers of a user are inserted into the finger sleeves, with the fingers being then forced by the user outward and relaxed inward for conditioning and drilling.

4. The finger strengthening device recited in claim 3, wherein the elastic component is a rubber band.

5. A finger strengthening device, comprising:

a plurality of finger sleeves, each having reticulations formed in a lateral surface of an entrance thereof;

a lower housing having a post disposed therein, and a plurality of guide slots formed along an outer rim thereof to provide for the insertion of the finger sleeves;

an upper housing assembled to the lower housing; and at least one elastic component installed between the post and each finger sleeve;

wherein fingers of a user are inserted into the finger sleeves, with the fingers being then forced by the user outward and relaxed inward for conditioning and drilling.

6. The finger strengthening device recited in claim 5, wherein the elastic component is a rubber band.

7. A finger strengthening device, comprising:

a plurality of finger sleeves, each having a slide track, and a post disposed in the slide track;

a lower housing having a post disposed therein, and a plurality of guide slots formed along an outer rim thereof to provide for the insertion of the finger sleeves;

an upper housing assembled to the lower housing; and at least one elastic component installed between the post of the lower housing and the post of each finger sleeve;

wherein fingers of a user are inserted into the finger sleeves, with the fingers being then forced by the user outward and relaxed inward for conditioning and drilling.

8. The finger strengthening device recited in claim 7, wherein the elastic component is a rubber band.

9. A finger strengthening device, comprising:

a plurality of finger sleeves, each having a slide track;

a plurality of covers, each cover being disposed over a respective slide track, an end of each respective cover and each respective slide track having an arcuate surface;

a lower housing having a post disposed therein, and a plurality of guide slots formed along an outer rim thereof to provide for the insertion of the finger sleeves;

an upper housing assembled to the lower housing; and at least one elastic installed between the post and each fingersleeve;

wherein fingers of a user are inserted into the finger sleeves, with the fingers being then forced by the user outward and relaxed inward for conditioning and drilling.

10. The finger strengthening device recited in claim 9, wherein the elastic component is a rubber band.

* * * * *